US012595923B2

(12) United States Patent
DeWald et al.

(10) Patent No.: US 12,595,923 B2
(45) Date of Patent: Apr. 7, 2026

(54) LEAKAGE DETECTION AND MITIGATION SYSTEM

(71) Applicant: Johnson Controls Tyco IP Holdings LLP, Milwaukee, WI (US)

(72) Inventors: Mason S. DeWald, Wichita, KS (US); Theresa Thy N. Gillette, Wichita, KS (US); Andrew M. Boyd, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 182 days.

(21) Appl. No.: 18/101,471

(22) Filed: Jan. 25, 2023

(65) Prior Publication Data

US 2023/0235907 A1 Jul. 27, 2023

(51) Int. Cl.
*F24F 11/36* (2018.01)
*F24F 11/64* (2018.01)
*F24F 11/58* (2018.01)

(52) U.S. Cl.
CPC ..... *F24F 11/36* (2018.01); *F24F 11/64* (2018.01); *F24F 11/58* (2018.01); *F25B 2500/222* (2013.01)

(58) Field of Classification Search
CPC ..... F25B 2500/222; F25B 2600/07
See application file for complete search history.

(56) References Cited

U.S. PATENT DOCUMENTS

2015/0345821 A1* 12/2015 Alsaleem ..... F24F 11/30 374/147
2018/0372365 A1* 12/2018 Nagasaka ..... F24F 11/52
2019/0170383 A1* 6/2019 Weinert ..... F25B 49/025
2019/0331377 A1* 10/2019 Matsuda ..... F25B 5/02

FOREIGN PATENT DOCUMENTS

KR 200435871 Y1 * 2/2007 ..... F24F 11/30
WO WO-2017002213 A1 * 1/2017 ..... F24F 11/36
WO WO-2017002214 A1 * 1/2017 ..... F24F 11/36
WO WO-2022019007 A1 * 1/2022 ..... F24F 11/36

* cited by examiner

*Primary Examiner* — Jerry-Daryl Fletcher
*Assistant Examiner* — Daniel C Comings
(74) *Attorney, Agent, or Firm* — Fletcher Yoder, P.C.

(57) ABSTRACT

A refrigerant leak detection system includes a sensor configured to detect a leaked portion of refrigerant external to a closed-loop refrigeration circuit of a heating, ventilation, and/or air conditioning (HVAC) system, memory circuitry having instructions stored thereon, and processing circuitry configured to execute the instructions to perform various functions. The functions include receiving, from the sensor, sensor feedback indicative of the leaked portion of the refrigerant. The functions also include transmitting, based on the sensor feedback, a notification indicative of the leaked portion of the refrigerant to a third party security server.

20 Claims, 10 Drawing Sheets

LEAKAGE DETECTION AND MITIGATION SYSTEM

CROSS REFERENCE TO RELATED APPLICATIONS

This application claims priority to and the benefit of U.S. Provisional Application Ser. No. 63/302,909, entitled "A LEAKAGE DETECTION AND MITIGATION SYSTEM," filed Jan. 25, 2022, and is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

A wide range of applications exists for HVAC systems. For example, residential, light-commercial, commercial, and industrial HVAC systems are used to control temperatures and air quality in residences and buildings. Generally, the HVAC systems may circulate a refrigerant through a refrigeration circuit between an evaporator, where the refrigerant absorbs heat, and a condenser, where the refrigerant releases heat. The refrigerant flowing within the refrigeration circuit is generally formulated to undergo phase changes within the normal operating temperatures and pressures of the system so that quantities of heat can be exchanged by virtue of the latent heat of vaporization of the refrigerant. As such, the refrigerant flowing within an HVAC system travels through multiple conduits and components of the refrigeration circuit.

Manufacturers may employ alternate or otherwise non-traditional refrigerants, such as A2L, to curb or reduce an environmental impact of such HVAC systems, to meet local regulatory standards, or both. Certain such refrigerants may be flammable and, thus, susceptible to combustion in certain conditions. Accordingly, it is now recognized that improved refrigerant leak detection and mitigation is desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a refrigerant leak detection system includes a sensor configured to detect a leaked portion of refrigerant external to a closed-loop refrigeration circuit of a heating, ventilation, and/or air conditioning (HVAC) system, memory circuitry having instructions stored thereon, and processing circuitry configured to execute the instructions to perform various functions. The functions include receiving, from the sensor, sensor feedback indicative of the leaked portion of the refrigerant. The functions also include transmitting, based on the sensor feedback, a notification indicative of the leaked portion of the refrigerant to a third party security server.

In one embodiment, one or more tangible, non-transitory, computer-readable media stores instructions thereon that, when executed by one or more processors, are configured to cause the one or more processors to perform various functions. The functions include receiving, from a sensor assembly, sensor feedback indicative of a leaked portion of the refrigerant. The functions also include determining, based on the sensor feedback, a refrigerant leak location of a heating, ventilation, and/or air conditioning (HVAC) system corresponding to the leaked portion of the refrigerant. The functions also include determining, based on the sensor feedback, a refrigerant leak severity corresponding to the leaked portion of the refrigerant. The functions also include generating a notification indicating a presence of the leaked portion of the refrigerant, the refrigerant leak location, and the refrigerant leak severity. The functions also include transmitting the notification to a third party security server.

In one embodiment, a method of detecting a refrigerant leak in a heating, ventilation, and/or air conditioning (HVAC) system includes receiving, via processing circuitry and from a sensor, sensor feedback indicative of a leaked portion of refrigerant corresponding to the HVAC system. The method also includes transmitting, via the processing circuitry and based on the sensor feedback, a notification indicative of the leaked portion of the refrigerant to a user device. The method also includes transmitting, via the processing circuitry and to the user device, a request to remedy an HVAC system leak corresponding to the leaked portion of the refrigerant, to acknowledge receipt of the notification, or both. The method also includes transmitting, via the processing circuitry and in response to not receiving, from the user device, a response to the request within a pre-defined threshold amount of time, a separate notification indicative of the leaked portion of the refrigerant to a third party security server.

BRIEF DESCRIPTION OF THE DRAWINGS

Various aspects of this disclosure may be better understood upon reading the following detailed description and upon reference to the drawings in which.

DETAILED DESCRIPTION

Figure 1:
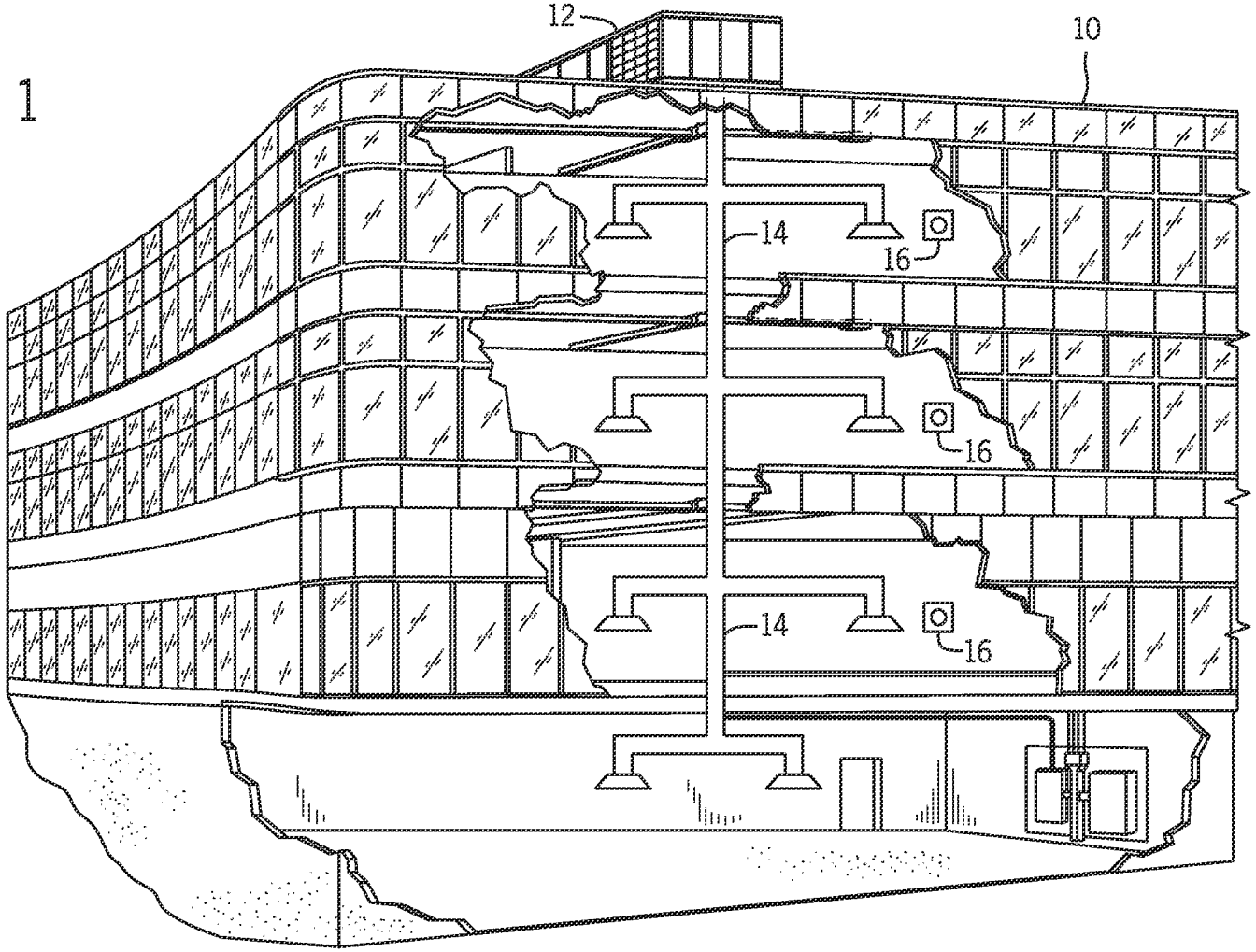
FIG. 1 is a perspective view of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to embodiments of a leak detection and mitigation assembly of a heating, ventilation, and/or air conditioning (HVAC) system. The leak detection and mitigation assembly may include a number of sensors disposed in various locations of the HVAC system, such as adjacent an evaporator, a condenser, a compressor, an expansion valve, a sub-cooler, an economizer, a terminal unit, an indoor unit, an outdoor unit, an air handling unit (AHU), a rooftop unit (RTU), etc. Processing circuitry of the leak detection and mitigation assembly may receive sensor feedback from one or more of the sensors and, based on the sensor feedback, identify an HVAC system refrigerant leak. The sensors may include, for example, refrigerant concentration sensors, vibration sensors (e.g., where vibrations of certain HVAC componentry may indicate a refrigerant leak), pressure sensors (e.g., refrigerant pressure sensors), or other types of sensors configured to detect a characteristic indicative of the HVAC system refrigerant leak.

In addition to identifying the HVAC system refrigerant leak, the processing circuitry may determine a location of the HVAC system refrigerant leak based on the sensor feedback, an extent or severity of the HVAC system refrigerant leak, or both. For example, the "extent" or "severity" may correspond to a concentration of refrigerant in air, an estimated concentration of refrigerant in air, or another related characteristic. The processing circuitry may generate one or more notifications (e.g., indicating a presence of the HVAC system refrigerant leak, the location of the HVAC system refrigerant leak, the extent or severity of the HVAC system refrigerant leak, or any combination thereof). In some embodiments, the processing circuitry may send one of the above-described notifications to a user device of a user corresponding to the space being conditioned by the HVAC system, such as an owner of the space, a manager of the space, an administrator of the space, etc. Further, the processing circuitry may solicit a response from the user device, such as an acknowledgement of receipt of the notification, a request for a response indicating that the HVAC system leak has been remedied or mitigated, or both.

In response to not receiving the response from the user device within a pre-defined threshold period of time, the processing circuitry may transmit a separate to a third party security server. "Third party" as used herein may denote componentry that does not belong to the above-described user of the above-described user device. As an example, the third party security server may correspond to a fire department or a paid monitoring security service.

In some embodiments, any of the above-described notifications may include data or information indicative of a safety protocol corresponding to the HVAC system leak. For example, the processing circuitry may determine whether the severity of the HVAC system refrigerant leak is greater than a threshold severity. In response to determining that the HVAC system refrigerant leak is greater than the threshold severity, the processing circuitry may include, in any of the above-described notifications, data or information recommending a first safety protocol. IN response to determining that the HVAC system refrigerant leak is not greater than the threshold severity, the processing circuitry may include, in any of the above-described notifications, data or information recommending a second safety protocol different than the first safety protocol. The first or second safety protocols, for example, may include recommendations regarding evacuation of the space corresponding to the HVAC system, furnishing of fire suppressant equipment, furnishing of fire protective gear, etc. In some embodiments, multiple severity thresholds may be employed, such as a first severity threshold and a second severity threshold that are employed to determine whether the severity of the HVAC system refrigerant leak is "low," "medium," or "high." In such embodiments, a first safety protocol corresponding to "low" severity, a second safety protocol corresponding to "medium" severity, and a third safety protocol corresponding to "high" severity may be employed.

Further, in some embodiments, the processing circuitry may transmit a notification to the third party security server without transmitting a notification to the user device, or substantially simultaneous with sending a notification to the user device. For example, in an embodiment, the processing circuitry may transmit the notification to the third party security server without transmitting a notification to the user device, or substantially simultaneous with sending a notification to the user device, in response to the severity of the HVAC system refrigerant leak falling within one or more severity categories, such as the "high" level of severity referenced above. In this way, personnel (e.g., firefighters) appropriate for mitigating risks associated with the HVAC system refrigerant leak may be notified.

By employing the above-described features, various risks associated with the HVAC refrigerant leak may be mitigated. Indeed, in certain embodiments employing alternate or otherwise non-conventional refrigerants, such as A2L, that are susceptible to combustion in certain conditions, features in accordance the present disclosure may reduce or negate a possibility of combustion and/or risks associated with combustion. These and other features are described in detail below.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
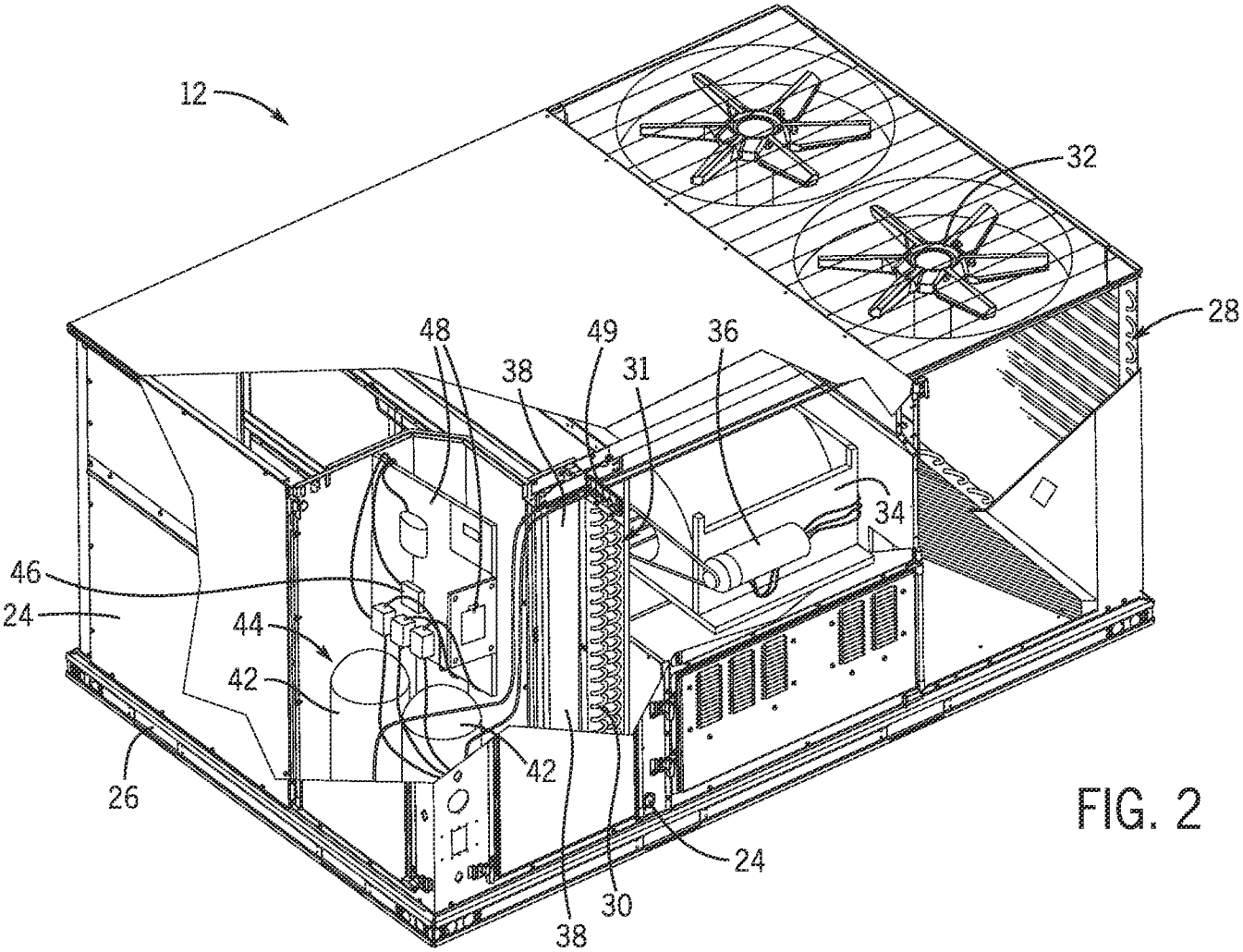
FIG. 2 is a perspective view of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
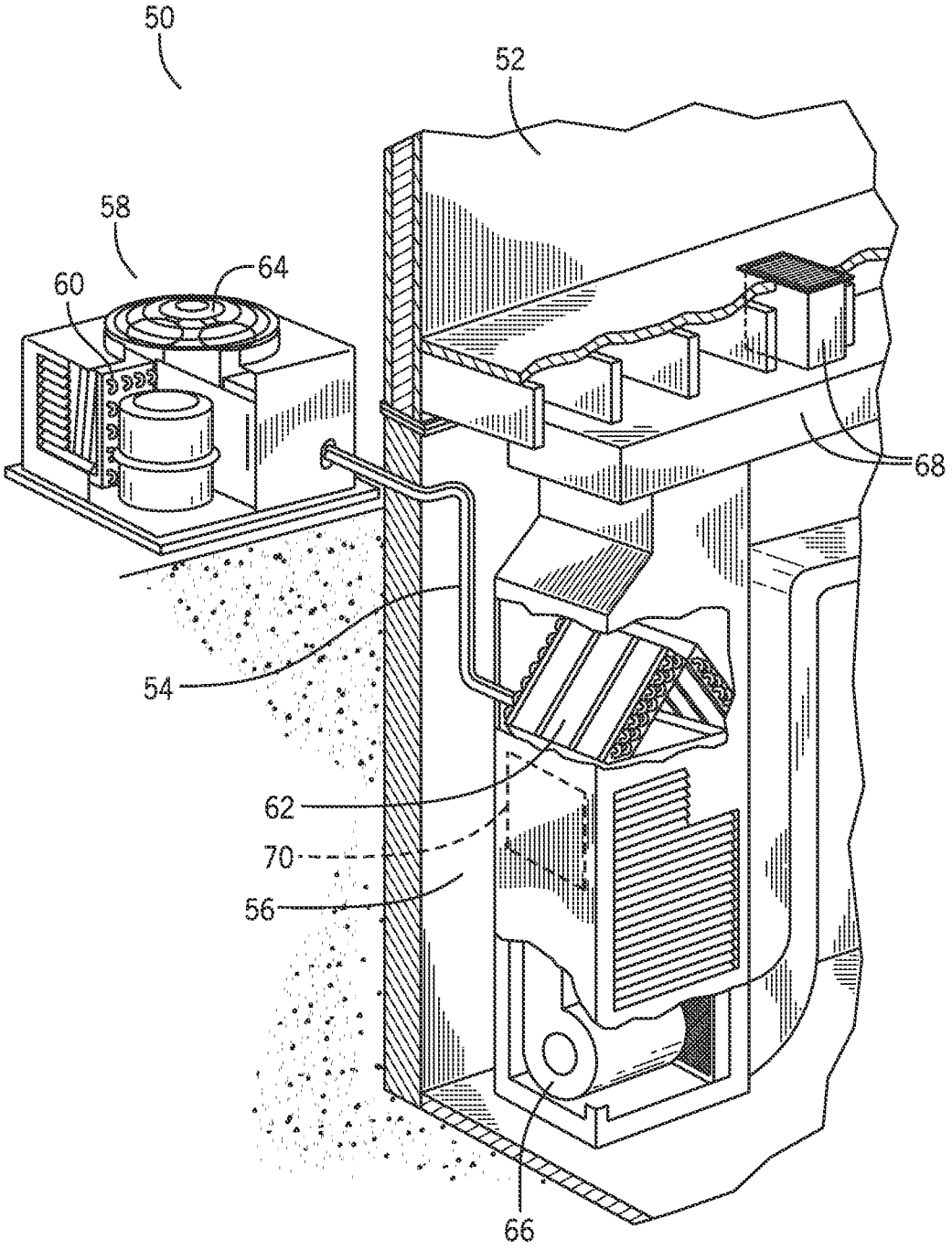
FIG. 3 is a cutaway perspective view of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
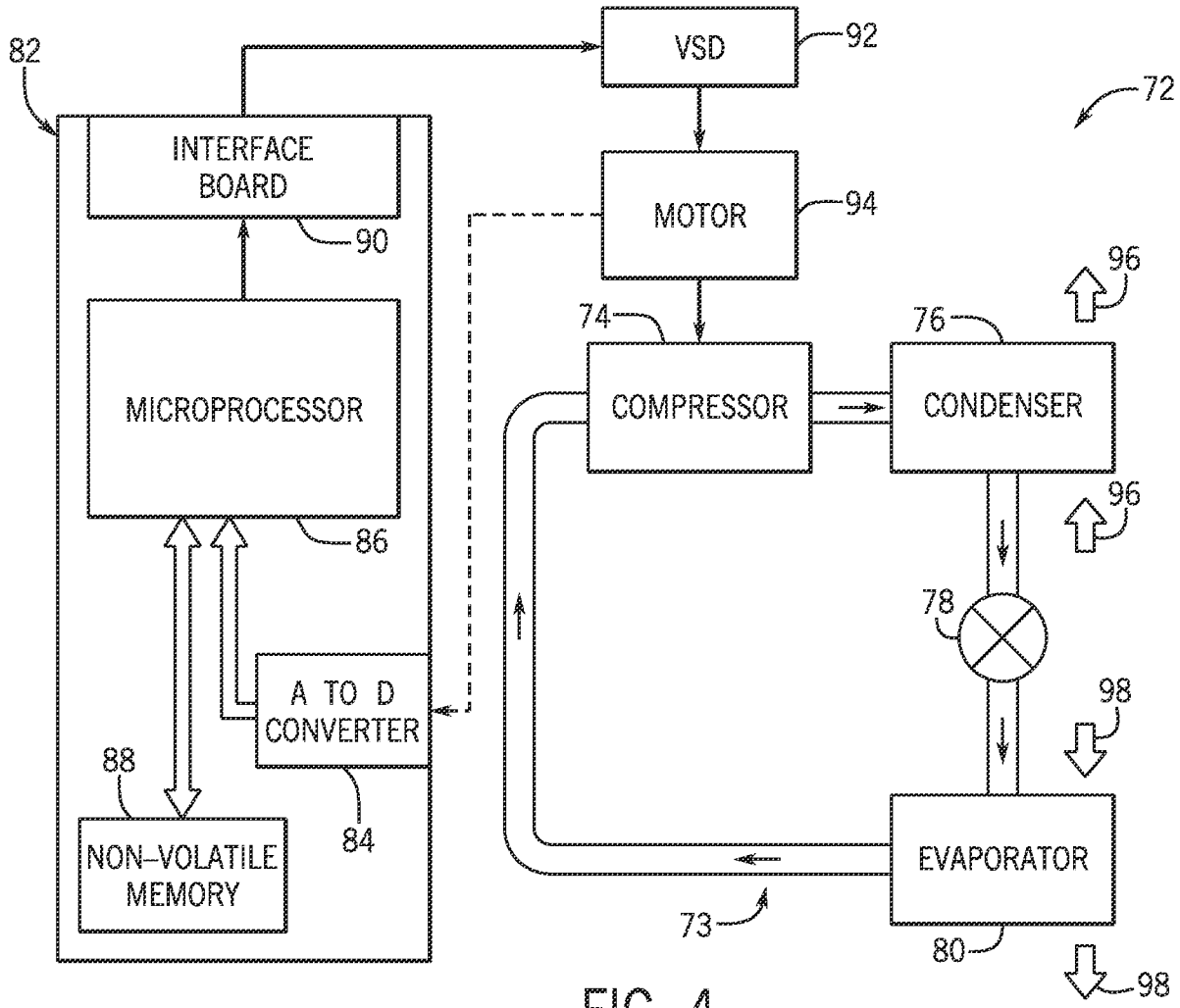
FIG. 4 is a schematic block diagram of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a refrigeration circuit 73 starting with a compressor 74. The refrigeration circuit 73 may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Each of the embodiments illustrated in FIGS. 1-4 includes various refrigerant leak detection and mitigation features described in detail below with reference to FIGS. 5-11. For example, a sensor assembly may be employed to detect an HVAC system refrigerant leak. Processing circuitry communicatively coupled with the sensor assembly may be configured to receive sensor feedback from the sensor assembly and, based on the sensor feedback, diagnose various characteristics of the HVAC system refrigerant leak, such as a location of the leak, an extent or severity of the leak, safety protocols associated with the extent or severity of the leak, etc. Further, the processing circuitry may be configured to transmit a notification indicating the HVAC system leak (and, in some embodiments, various characteristics of the HVAC system leak) to a third party security server (e.g., a paid monitoring service, a fire department, etc.). The processing circuitry may also be configured to transmit a notification indicating the HVAC system leak (and, in some embodiments, various characteristics of the HVAC system leak) to a user device associated with an occupant, manager, or owner of the space being conduction by the HVAC system. In some embodiments, the processing circuitry may selectively transmit the notification to the third party security server and/or the user device based on the severity of the HVAC system leak, based on a responsiveness of one or more parties associated with the user device, etc. These and other features will be described in detail below.

Figure 5:
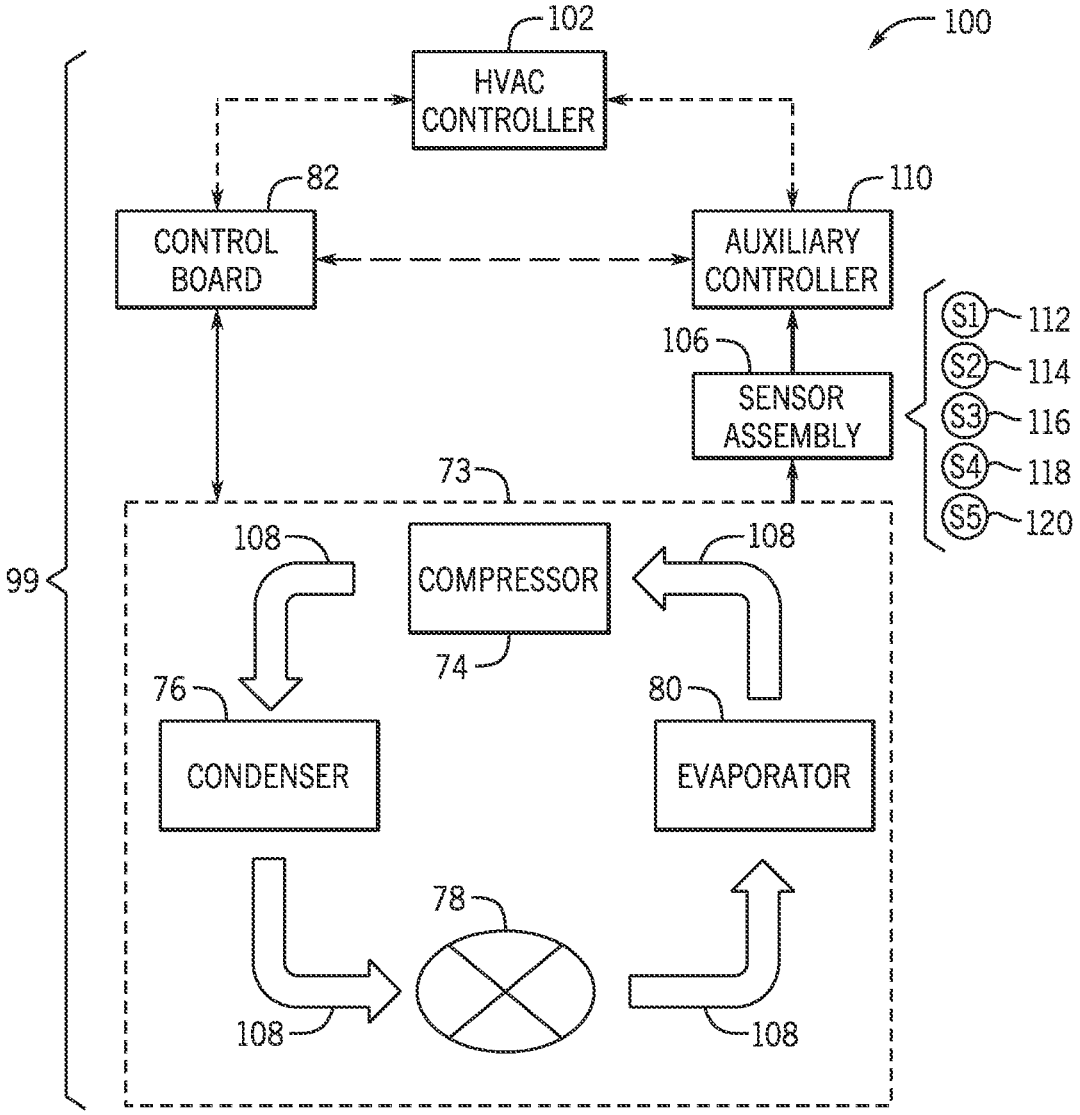
FIG. 5 is a schematic block diagram of an HVAC system including a refrigerant leak detection assembly, in accordance with an aspect of the present disclosure.

With the foregoing in mind, FIG. 5 is a schematic block diagram of an embodiment of an HVAC system 99 including a refrigerant leak detection assembly 100. As shown, the HVAC system 99 may include a refrigeration circuit, such as the refrigeration circuit 73 referenced above with respect to FIG. 4. While certain componentry is described below in the context of the refrigeration circuit 73 of FIG. 4, it should be understood that the refrigerant leak detection assembly 100 in FIG. 5 may be employed with respect to other types or embodiments of the HVAC system 99, such as those illustrated in FIGS. 1-3 of the present disclosure and/or others.

As previously described, the refrigeration circuit 73 may include the compressor 74, the condenser 76, the expansion valve 78, the evaporator 80, and refrigerant flow paths 108 between the above-described componentry. Accordingly, the compressor 74, the condenser 76, the expansion valve 78, the evaporator 80, and refrigerant flow paths 108 may form a closed-loop of the refrigeration circuit 73.

In certain conditions, the refrigerant flowing within the refrigeration circuit 73 may inadvertently leak due to wear and tear, aging, damage to components, faulty joints, faulty connections, improper installation and maintenance procedures or componentry, etc. In accordance with the present disclosure, the refrigerant leak detection assembly 100 is configured to detect a leaked portion of refrigerant corresponding to the refrigeration circuit 73, and to transmit one or more notifications indicating the HVAC system refrigerant leak (and, in some embodiments, characteristics of the HVAC system refrigerant leak) to one or more devices (e.g., servers). For example, a sensor assembly 106 employing one or more sensors may be configured to detect the HVAC system refrigerant leak (e.g., via detecting a presence of refrigerant in air) and communicate sensor feedback indicative of the HVAC system refrigerant leak to an HVAC controller 102, an auxiliary controller 110, or both.

As shown, the sensor assembly 106 may include one or more sensors, such as a first sensor 112, a second sensor 114, a third sensor 116, a fourth sensor 118, and a fifth sensor 120. The first sensor 112 may be positioned adjacent to the compressor 74 and/or configured to detect an HVAC system refrigerant leak near the compressor 74, the second sensor 114 may be positioned near the condenser 76 and/or configured to detect an HVAC system refrigerant leak near the condenser 76, the third sensor 116 may be positioned near the expansion valve 78 and/or configured to detect an HVAC system refrigerant leak near the expansion valve 78, and the fourth sensor 118 may be positioned near the evaporator 80 and/or configured to detect an HVAC system refrigerant leak near the evaporator 80. The fifth sensor 120 may be configured to detect the HVAC system refrigerant leak in some other area of the HVAC system 99, such as near one of the refrigerant flow paths 108. While five sensors 112, 114, 116, 118, 120 are shown in the illustrated embodiment, in other embodiments, a different number of sensors may be provided, such as only one sensor.

Further, the one or more sensors of the sensor assembly 106 may include various types of sensors, such as refrigerant concentration sensors, vibration sensors (e.g., where vibrations of certain HVAC componentry may indicate an HVAC system refrigerant leak), pressure sensors (e.g., refrigerant pressure sensors), or other types of sensors configured to detect a characteristic indicative of the HVAC system refrigerant leak. In one example, at least one sensor of the sensor assembly 106 may measure refrigerant concentration as a percent of refrigerant to air mix in a known space, for example, within a compartment of the evaporator 80. The sensor assembly 106 may be calibrated to the particular HVAC system 99 and the size of compartment in which it (or componentry thereof) is deployed. In one embodiment, the type of sensor 106 is selected based on the type of refrigerant flowing within the refrigeration circuit 73. The type of refrigerant can be one of, but not limited to, a nontoxic and partially flammable refrigerant, a nontoxic and not flammable refrigerant, a nontoxic and flammable refrigerant, a nontoxic and highly flammable refrigerant, etc. For example, the refrigerant may include one of R-32, R-452B, R-134A, R-447A, R-455A, R-32, R-1234ze, R-1234yf, R-454A, R-454C, R-454B, R-410A, A2L, A2, A3 or any other suitable type of refrigerant.

As previously described, the sensor assembly 106 may be configured to transmit sensor feedback to one or more devices, such as the HVAC controller 102 and/or the auxiliary controller 110. The HVAC controller 102 may be, but is not limited to, a thermostat, a security panel, a fire panel, or any other suitable electronic device having communication (e.g., wired communication or wireless communication or both) and processing capabilities. Additionally, the HVAC controller 102 may be equipped with a user interface. The user interface can include, but is not limited to, a display device, a touch panel, push button(s), knob(s), microphone(s), or any combination thereof. In some embodiments, the HVAC controller 102 is provided with one of visual indicator(s), buzzers, speaker, microphone, and color-coded notifiers.

The auxiliary controller 110 may periodically receive data indicative of the one or more sensed values from the sensor assembly 106. In some other embodiments, the auxiliary controller 110 may generate a request signal instructing the sensor assembly 106 to provide the sensed value(s). Further, the auxiliary controller 110 may be configured to evaluate the sensed value, such as refrigerant concentration data. The auxiliary controller 110 may determine, based on the sensed values, that a refrigerant leakage has occurred. In response to detection of refrigerant leakage, the auxiliary controller 110 may generate a leakage detection signal to indicate leakage of the refrigerant. In some embodiments, in addition to determining a presence of the HVAC system leak, the auxiliary controller 110 may determine a location of the leak, an extent or severity of the leak, and/or other characteristics of the leak. The location, the extent or severity, and/or other characteristics of the leak may be included in the leakage detection signal. The extent or severity of the leak may refer to an amount or concentration of refrigerant in air, an estimated amount or concentration of refrigerant in air, or another related characteristic. As an example, a relatively high concentration of refrigerant in air may correspond to a relatively high extent or severity of the leak, while a relatively low concentration of refrigerant in air may correspond to a relatively low extent or severity of the leak. In some embodiments, the extent or severity may be dependent on which component is acting as a source of the leak.

In an embodiment, the auxiliary controller 110 is communicatively coupled to the HVAC controller 102 and the control board 82 of the HVAC system 99. The communication connection may be a wired or a wireless connection. In some embodiments, the auxiliary controller 110, the control board 82, and the HVAC controller 102 may be synched in time and utilize handshake network communication. In some other embodiments, the auxiliary controller 110, the control board 82, and the HVAC controller 102 may utilize existing building system communication protocols, such as BACnet. It is to be noted that, the auxiliary controller 110, the control board 82, and the HVAC controller 102 can utilize the same or different communication protocols. In some embodiments, where more than one communication protocol is utilized, the refrigerant leak detection assembly 100 may include appropriate signal conditioners or signal interpreters to establish effective data transfer between controllers. The signal conditioners or signal interpreters are electronic devices implemented using one or more processors functioning as mediators between the controllers.

The auxiliary controller 110 may be configured to transmit the leakage detection signal (or notifications corresponding thereto) to the control board 82, the HVAC controller 102, some other device or sever, or any combination thereof. In some embodiments, subsequent to reception of the leakage detection signal, the control board 82 and/or HVAC controller 102 may generate one or more control signals for performing one or more leakage prevention operations such as controlling speed of supply fan, controlling operation of damper, disconnecting components of HVAC system 99 from power, modifying operation of devices such as ceiling fans, exhaust fans, and smoke detectors, evacuating refrigerant, stopping compressor, trap (outdoor unit) etc.

Further, as described in detail below, the auxiliary controller 110, the HVAC controller 102, the control board 82, or any combination thereof may be configured to transmit one or more notifications to various devices (e.g., a user device corresponding to a person associated with the HVAC system 99 or the space being conditioned by the HVAC system 99, a third party security server, etc.). The one or more notifications, described in detail below with reference to later drawings, may indicate a presence of the HVAC system leak, a location of the HVAC system leak, an extent or severity of the HVAC system leak, safety protocols associated with the extent or severity of the HVAC system leak, other information, or any combination thereof. In some embodiments, the notification(s) may include information indicative of the building (e.g., building specifications) and/or HVAC system (e.g., HVAC specifications) conditioning one or more spaces in the building. Such information, which may be downloaded from a database (e.g., via the auxiliary controller 110), may enable emergency response teams (e.g., firefighters) to safely navigate the building and address any risks associated with the HVAC system refrigerant leak. Such information may be included, for example, in the safety protocol(s) and/or recommendations for mitigating/repairing/blocking the HVAC system leak.

In some embodiments, notifications may be transmitted via a tiered approach. For example, in an embodiment, a notification may be transmitted to the user device and, in response to not receiving a response to the notification within a pre-defined threshold amount of time, a separate notification may be transmitted to the third party security server. In another embodiment, a notification may be transmitted to the user device in response to the extent or severity of the HVAC system refrigerant leak not exceeding a threshold amount, and a separate notification may be transmitted to the third party security server in response to the extent or severity of the HVAC system refrigerant leak exceeding the threshold amount (e.g., in addition to, or in the alternate of, the notification to the user device). These and other features are described in detail below with reference to later drawings.

Figure 6:
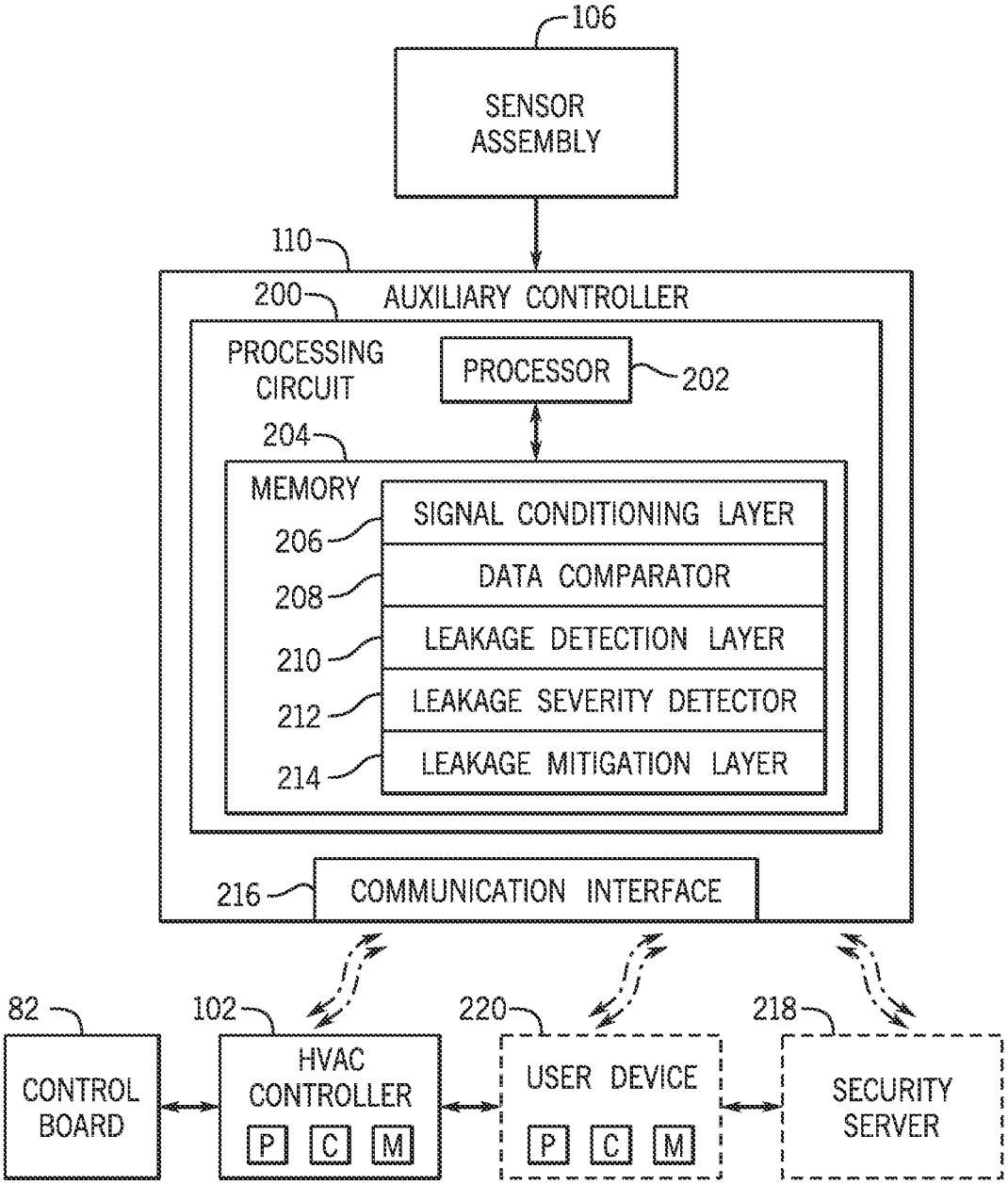
FIG. 6 is a schematic block detailed diagram of the refrigerant leak detection assembly of FIG. 5, in accordance with an aspect of the present disclosure.

FIG. 6 is a schematic block detailed diagram of an embodiment of the refrigerant leak detection assembly 100 of FIG. 5, including a detailed view of the auxiliary controller 110. In the illustrated embodiment, the auxiliary controller 110 includes a processing circuit 200 having a processor 202 (e.g., processing circuitry) and a memory 204 (e.g., memory circuitry). The processor 202 may be a general purpose or specific purpose processor, an application specific integrated circuit (ASIC), one or more field programmable gate arrays (FPGAs), a group of processing components, or other suitable processing components. The processor 202 may be configured to execute computer code or instructions stored in the memory 204 or received from other computer readable media (e.g., CDROM, network storage, a remote server, etc.).

The memory 204 may include one or more devices (e.g., memory units, memory devices, storage devices, etc.) for storing data and/or computer code for completing and/or facilitating the various processes described in the present disclosure. The memory 204 may include random access memory (RAM), read-only memory (ROM), hard drive storage, temporary storage, non-volatile memory, flash memory, optical memory, or any other suitable memory for storing software objects and/or computer instructions. The memory 204 may include database components, object code components, script components, or any other type of information structure for supporting the various activities and information structures described in the present disclosure. The memory 204 may be communicably connected to the processor 202 via processing circuit 200 and may include computer code for executing (e.g., by processor 202) one or more processes described herein. When the processor 202 executes instructions stored in the memory 204 for completing various activities described herein, the processor 202 generally configures processing circuit 200 to complete such activities.

The auxiliary controller 110 further includes a communication interface 216 that is configured to establish electronic communication between the processing circuit 200 and one or more of sensor assembly 106, the HVAC controller 102, the control board 82, at least one security server 218 (e.g., third party security server, such as a paid monitoring service or fire department server), and a user device 220. In some embodiments, the communication interface 216 facilitates connection of the auxiliary controller 110, and therefore the processing circuit 200, with one or more components of the HVAC system 99 (e.g., of FIG. 5). In some embodiments, the communication interface 216 may be configured to establish either a direct communication or an indirect communication with the security server 218. For an example, in indirect communication, the data and/or signal may be shared with the security server 218 via the user device 220 at discretion of the user. The data and/or signal may be transmitted to the HVAC controller 102 that in turn may transmit the data and/or signal to the user device 220, or in some scenarios, the data and/or signal may be transmitted to the user device 220 directly by the communication interface 216.

In some implementations, the communication interface 216 may include wired or wireless interfaces (e.g., jacks, antennas, transmitters, receivers, transceivers, wire terminals, etc.) for conducting data communications with various systems, devices, or networks. The communication interface 216 can include an Ethernet card and port for sending and receiving data via an Ethernet-based communications network. In another example, communication interface 216 includes a Wi-Fi transceiver for communicating via a wireless communications network. The communication interface 216 may be enabled to establish connection over wired and/or wireless private network, personal area network, local area networks or wide area networks (e.g., the Internet, a building WAN, etc.).

In some embodiments, the communication interface 216 includes an application gateway configured to receive input from applications running on one of, but not limited to, a remote server (e.g., such as the security server 218, which may correspond to a paid monitoring service or a fire department), the HVAC controller 102, a BMS (Building Management System) controller (not shown in Figs.), or the control board 82. For example, the communication interface 216 may include one or more wireless transceivers (e.g., a Wi-Fi transceiver, a Bluetooth transceiver, an NFC transceiver, a cellular transceiver, etc.) for establishing communication. The communication interface 216 can include any number of software buffers, queues, listeners, filters, translators, or other communications-supporting services.

Still referring to FIG. 6, the memory 204 may include a signal conditioning layer 206, a data comparator 208, a leakage detection layer 210, a leakage severity detector 212, and a leakage mitigation layer 214. The signal conditioning layer 206 may be configured to communicate with the sensor assembly 106 via the communication interface 216 to receive the sensed value(s). The signal conditioning layer 206 may perform one or more data conversion techniques to normalize the sensed value. That is, the signal conditioning layer 206 transforms the sensed value to a suitable format to enable the processing circuit 200 to correlate between the sensed value and threshold value(s) that is pre-stored in the memory 204 or a database (not shown in figures). In some embodiments, the signal conditioning layer 206 may be configured to determine the S.I. unit of stored threshold value(s) based on which one or more data conversion techniques may be applied on the sensed value for conversion of the sensed value to the S.I. unit of stored threshold value. For an example, the sensed value received from the sensor 106 can be in Pascal and the threshold value(s) stored in the database can be in Bars/atmospheric pressure (atm) or Pound-force per square inch (PSI). In such cases, the signal conditioning layer 206 applies one or more suitable conversion techniques to convert the sensed value received in Pascal to PSI or Bars/atmospheric pressure (atm).

Further, the processing circuit 200 may include the data comparator 208 that receives the sensed value from the signal conditioning layer 206 and further compares the sensed value with the threshold value stored in the database. The data comparator 208 determines difference between the sensed value and the threshold value by performing one or more arithmetic operations. The leakage detection layer 210 may be configured to cooperate with the data comparator 208 to detect refrigerant leakage. The leakage detection layer 210 may receive the difference between the sensed value and the threshold value, and based on the difference determines a presence of refrigerant leakage. In some embodiments, the leak detection layer 210 (or another layer) may determine a location of the refrigerant leak, where the location corresponds to, for example, which sensor of the sensor assembly 106 detected the refrigerant leak. The leakage detection layer 210 may generate a flag signal subsequent to the detection of refrigerant leakage. For an example, the leakage detection layer 210 may determine refrigerant leakage, and generate the flag signal, when the sensed value meets a pre-determined relationship with one or more threshold values.

In some embodiments, the leakage severity detector 212 is configured to cooperate with the leakage detection layer 210 and the data comparator 208 to determine an extent or severity of the refrigerant leak. The leakage severity detector 212 receives the flag signal from the leakage detection layer 210 and subsequently, periodically, sends one or more request signals to the data comparator 208 requesting a difference between the sensed value and the threshold value(s). In some embodiments, of the present disclosure, the leakage severity detector 212 is configured to evaluate a difference between the sensed value and the threshold value to determine severity level of refrigerant leakage.

Still further, the memory 204 may include a leakage mitigation layer 214. The leakage mitigation layer 214 is configured to cooperate with the leakage detection layer 210 to receive the flag signal. Further, subsequent to reception of the flag signal, the leakage mitigation layer 214 may be configured to generate the leakage detection signal. In some embodiments, the leakage mitigation layer 214 may coordinate with the leakage severity detector 212 to additionally receive the severity identifier (e.g., indicating a first severity, a second severity, a third severity, etc., such as a low severity, a medium severity, or a high severity).

Still further, the auxiliary controller 110 or the HVAC controller 102 may be configured to transmit one or more notifications indicative of the HVAC system refrigerant leak (and, in some embodiments, characteristics thereof) to one or more devices, such as the user device 220, the security server 218, or both. In some embodiments, a notification may be transmitted first to the user device 220, and then to the security server 218 in response to not receiving a response to the notification from the user device 220 within a threshold amount of time. Additionally or alternatively, the user device 220 may be presented with an option to transmit the notification to the security server 218. Additionally or alternatively, notifications may be transmitted to the user device 220, the security server 218, or both based upon a severity of the HVAC system refrigerant leak. For example, in an embodiment, the HVAC controller 102 or auxiliary controller 110 may transmit a notification to the user device 220 and not the security server 218 in response to the severity of the HVAC system refrigerant leak being relatively low, and to the security server 218 (e.g., in addition to or in the alternate of the user device 220) in response to the severity of the HVAC system leak being relatively high. These and other features are described in detail below with reference to later drawings.

Figure 7:
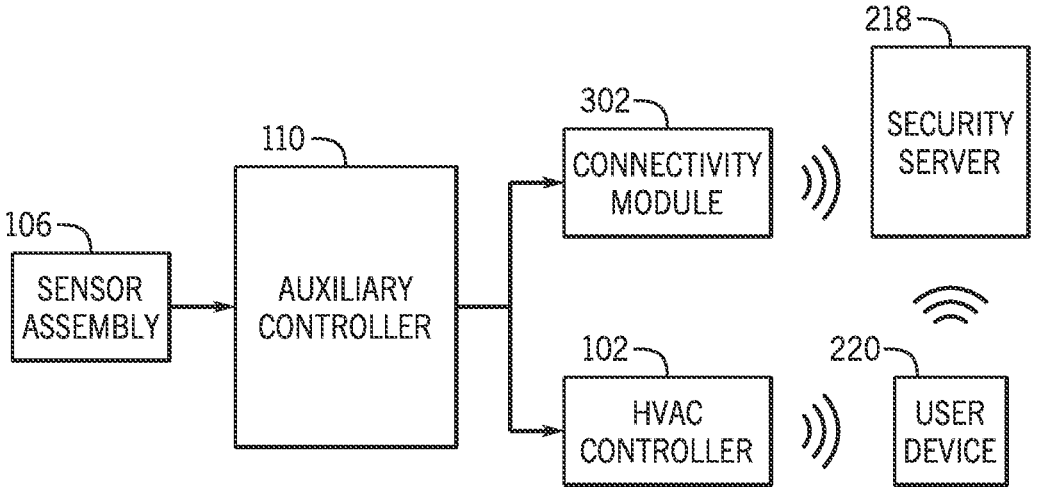
FIG. 7 is a schematic block diagram of various electronic devices that may be employed in, or interact with, the refrigerant leak detection assembly of FIG. 5, in accordance with an aspect of the present disclosure.

FIG. 7 is a schematic block diagram of an embodiment of various electronic devices that may be employed in, or interact with, the refrigerant leak detection assembly 100 of FIG. 5. For example, as previously described, one or more notifications may be transmitted (e.g., by the auxiliary controller 110 and/or the HVAC controller 102) to the user device 220 (e.g., corresponding to a user associated with the space being conditioned by the HVAC system), to the security server 218 (e.g., corresponding to a paid monitoring service, a fire department, etc.), or both.

In the embodiment illustrated in FIG. 7, the auxiliary controller 110 may be communicatively coupled to the security server 218 via a connectivity module 302 to facilitate electronic communication between the auxiliary controller 110 and the security server 218. For example, the auxiliary controller 110 may be communicatively coupled with the connectivity module 302 via wired or wireless connections. The auxiliary controller 110 may transmit a notification indicative of an HVAC system refrigerant leak to the security server 218 via the connectivity module 302. The notification may include, but is not limited to, information indicative of a location of the HVAC system refrigerant leak, a severity of the HVAC system refrigerant leak, a safety protocol (e.g., associated with the severity of the HVAC system refrigerant leak), presence of a fire, etc. The security service associated with the security server 218 may perform one or more safety operations in response to receiving the leakage detection signal such as, but not limited to, evacuating building occupants, fire-fighting, repairing or stopping the HVAC system refrigerant leak, etc.

As shown, the auxiliary controller 110 may also be communicatively connected to the HVAC controller 102. However, in some non-limiting embodiments, the HVAC controller 102 can be connected with the auxiliary controller 110 via the connectivity module 302. The auxiliary controller 110 transmits a leakage detection signal (or information) to the HVAC controller 102. In some embodiments, the leakage detection signal may be transmitted to the user interface associated with the HVAC controller 102. Subsequent to reception of the leakage detection signal, the HVAC controller 102 may generate one or more control signals for performing certain leakage prevention operations such as controlling speed of supply fan, controlling operation of damper, disconnecting components of HVAC system from power, modifying operation of devices such as ceiling fans, exhaust fans, and smoke detectors, evacuating refrigerant, stopping compressor, trap (outdoor unit) etc.

Additionally, in some embodiments, the HVAC controller 102 may transmit a notification indicative of the HVAC system leak to the user device 220. In other embodiments, the notification may be transmitted to the user device 220 from the auxiliary controller 110 directly or from the connectivity module 302. The user device 220 may be an electronic device of a user such as a homeowner, a building manager, or an entity associated with the HVAC system. The user device 220 may be provided with a software application such as a mobile application, a desktop application etc., to facilitate communication with the HVAC controller 102, the auxiliary controller 110, the connectivity module 302, etc. In some embodiments, the notification indicative of the HVAC system refrigerant leak may be transmitted to a user interface associated with the user device 220.

The one or more notifications (e.g., to the user device 220, the security server 218 [which may include, or be used to refer to, a security device, such as a computing device associated with a paid monitoring service or fire department], or both) may be in form of text, graphics, audio, video, buzzers, color-coded notifiers or any combination thereof. For example, a notification icon may be provided to display the one or more notifications from the auxiliary controller 110 or the HVAC controller 102. In other embodiments, the notification icon may be accompanied or replaced by audible alerts or indicators, flashing lights, or any other suitable means of notification.

In some embodiments, the one or more notifications may include various types of information associated with the HVAC system refrigerant leak such as an identifier (ID) of the sensor of the sensor assembly 106 that detected leakage of the refrigerant, installation location of the sensor, identifier (ID) of a corresponding component of the refrigeration circuit that is associated with the HVAC system refrigerant leak, installation location of the corresponding component, date and time of sensing the refrigerant leakage, sensed concentration of the leaked refrigerant, safety protocols associated with an extent or severity of the leak, and the like. Further, as described with reference to later drawings, a notification to the user device 220 may include a request to respond to the notification within a pre-defined threshold amount of time. In response to not receiving the response within the pre-defined threshold amount of time, the auxiliary controller 110 (or HVAC controller) may transmit a notification to the security server 218.

In some embodiments, one or more recommendations may be provided in any of the above-described notifications, such as a safety protocol recommendation, a recommendation for mitigating, repairing, or blocking the HVAC system refrigerant leak, etc. In some embodiments, the one or more recommendations may be in form of text, graphics, audio, video, etc., or any combination thereof. For example, the user interface of the user device 220 may allow the user to alert one or more technicians to mitigate the leakage of the refrigerant. Additionally, the user interface may allow the user to alert one or more security servers, such as the security server 218, to mitigate the leakage of the refrigerant (and/or risks associated with the leakage). In some embodiments, information relating to the HVAC system refrigerant leak may be shared with the security server 218 via the user device 220 at the discretion of the user. The user device 220 may communicate with the security server 218 to alert the security service associated with the security server 218 for the detected refrigerant leakage in the HVAC system 11. The security service may perform the one or more safety operations in response to the refrigerant leakage. However, in other embodiments, a notification may be transmitted to the security server 218 without discretion of the user of the user device 220.

Figure 8:
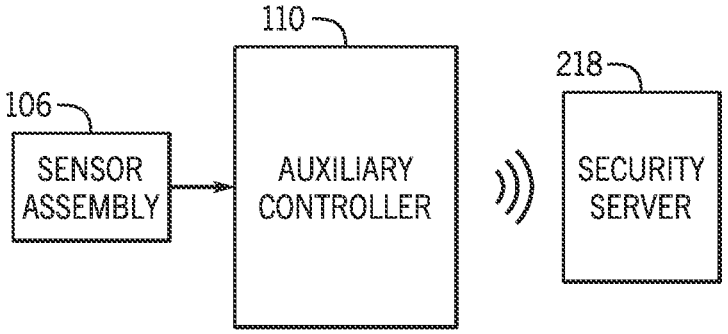
FIG. 8 is a schematic block diagram of various electronic devices that may be employed in, or interact with, the refrigerant leak detection assembly of FIG. 6, in accordance with an aspect of the present disclosure.

FIG. 8 is a schematic block diagram of an embodiment of various electronic devices that may be employed in, or interact with, the refrigerant leak detection assembly 100 of FIG. 6. In the illustrated embodiment, the auxiliary controller 110 may communicate with the security server 218 directly via a communication interface such as the communication interface 216 shown in FIG. 6. The auxiliary controller 110 may transmit the leakage detection signal in the form of one or more notifications directly to the security server 218, indicating a presence of the HVAC system refrigerant leak, a location of the HVAC system refrigerant leak, an extent or severity of the HVAC system refrigerant leak, recommendations regarding safety protocols corresponding to the HVAC system refrigerant leak, other types of recommendations (e.g., a how-to guide regarding how to mitigate, repair, or block the HVAC system refrigerant leak, etc. In some embodiments, the leakage detection signal (or notification) may be transmitted to the security server 218 only if the severity identifier indicates that the severity of the refrigerant leakage is relatively high. In other embodiments, the leakage detection signal (or notification) may be transmitted to the security server 218 in response to the auxiliary controller 110 not receiving an acknowledgement of receipt of a notification at the user device 220 illustrated in FIGS. 6 and 7.

Figure 9:
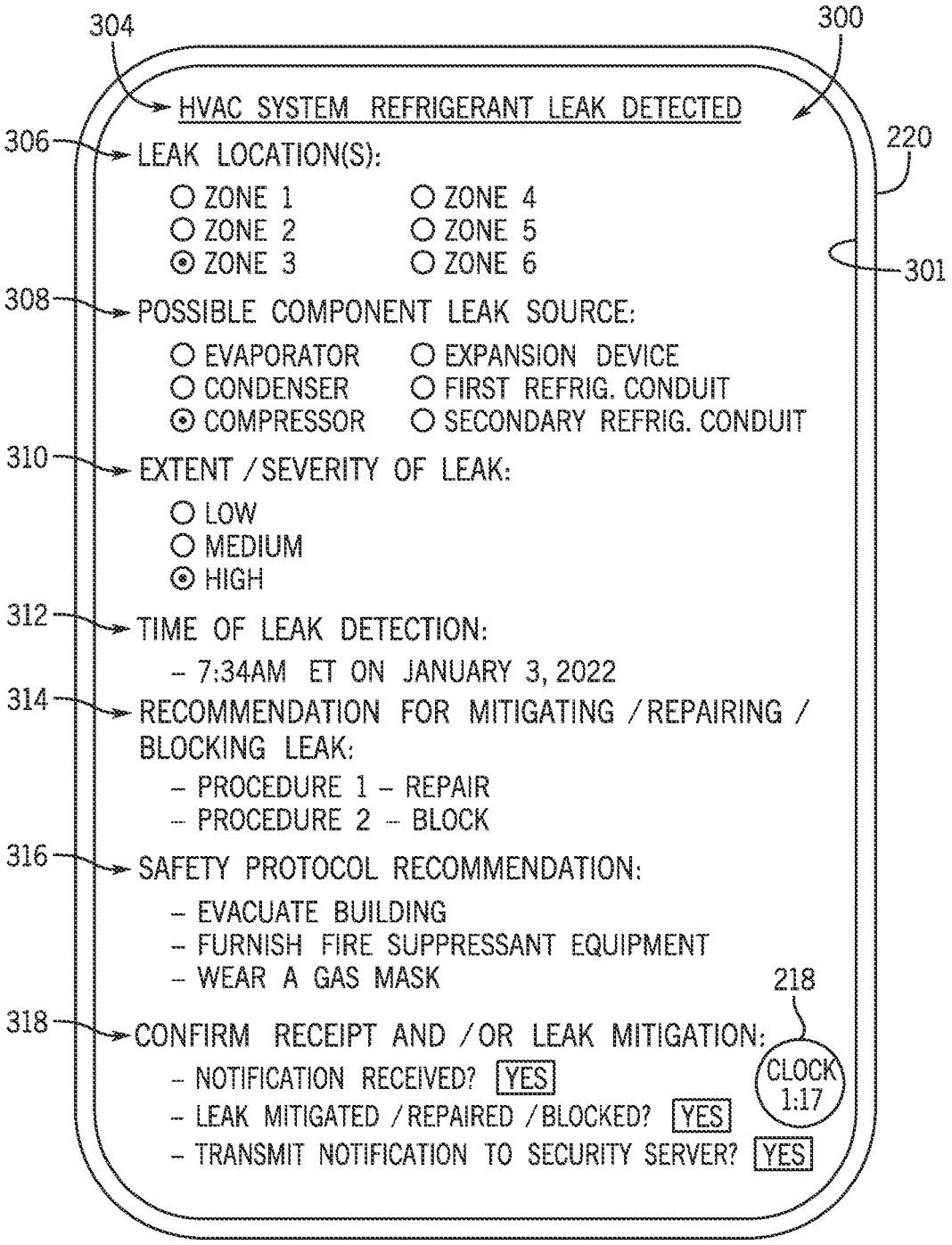
FIG. 9 is a graphical user interface (GUI) employed in one or more of the electronic devices in FIGS. 5-8, in accordance with an aspect of the present disclosure.

FIG. 9 is an embodiment of a graphical user interface (GUI) 300 employed in one or more of the electronic devices in FIG. 5-8. For example, FIG. 9 illustrates the GUI 300 on a display 301 of the user device 220 illustrated in FIGS. 6 and 7. However, the same or similar GUI 300 may be presented on a device corresponding to the third party security server 218 (e.g., third party security server).

In the illustrated embodiment, the GUI 300 includes a leak detection indication 304, a leak location indication 306, a possible component leak source indication 308, a leak extent/severity indication 310, a leak detection time indication 312, a recommendation for mitigating/repairing/blocking the leak indication 314, and a safety protocol recommendation indication 316. The leak location indication 306 may include information indicative of various zones (e.g., a first zone, a second zone, a third zone). In some embodiments, for example, the first zone may be an evaporator zone or compartment, the second zone may be a condenser zone or compartment, the third zone may be a compressor zone or compartment, the fourth zone may be an expansion device zone or compartment, the fifth zone may be a conditioned space, and the sixth zone may be a refrigerant conduit zone. In the illustrated GUI 300, the third zone is indicated as the location of the HVAC system refrigerant leak. It should be noted that, in certain conditions, multiple zones may be affected and indicated in the leak location indication 306.

The possible component leak source indication 308 may include an indication of one or more components of the HVAC system that is causing the leak, such as the evaporator, the condenser, the compressor, the expansion device, a first refrigerant conduit, a second refrigerant conduit, or any other HVAC system device described in the present disclosure, among others. In the illustrated GUI 300, the compressor is indicated as a possible leak source. It should be noted that, in certain conditions, multiple HVAC components may be indicated as possible refrigerant leak sources in accordance with the present disclosure.

The leak extent/severity indication 310 may include an indication of the extent or severity of the detected HVAC system refrigerant leak, such as a "low" extent/severity, a "medium" extent/severity, or a "high" extent/severity. As previously described, the extent or severity of the HVAC system refrigerant leak may be determined based on a comparison of the sensor feedback with one or more thresholds. For example, the sensor feedback may indicate a concentration of refrigerant in air, which may be compared against a first concentration threshold and a second concentration threshold. In response to the concentration of refrigerant in air being less than the first concentration threshold, the extent or severity of the HVAC system refrigerant leak may be "low." In response to the concentration of refrigerant in air being greater than the first concentration threshold and less than the second concentration threshold, the extent or severity of the HVAC system refrigerant leak may be "medium." In response to the concentration of refrigerant in air being greater than the second concentration threshold, the extent or severity of the HVAC system refrigerant leak may be "high." In the illustrated embodiment, the extent/severity of leak indicator 310 includes an indication that the extent or severity of the HVAC system refrigerant leak is "high." As shown, the time of leak detection indication 312 may include an indication of the time at which the HVAC system refrigerant leak was detected.

The recommendation for mitigating/repairing/blocking the leak indication 314 may include one or more procedures associated with the HVAC system refrigerant leak, such as a first procedure for repairing the leak, a second procedure or blocking the leak (which may or may not repair the condition causing the leak), etc. The safety protocol recommendation indication 316 may include various safety protocols associated with the HVAC system refrigerant leak, such as an evacuation protocol, a first suppressant equipment protocol, a different protocol, or any combination thereof. In some embodiments, the safety protocol recommended on the GUI 300 may be based on the extent or severity of the HVAC system refrigerant leak. For example, for an HVAC system refrigerant leak having a "low" severity, the safety protocol may include a recommendation to wear a mask, having a "medium" severity, the safety protocol may include evacuating the building (in addition to wearing the mask), and having a "high" severity, the safety protocol may include furnishing fire suppressant equipment (in addition to wearing a mask and evacuating the building). The above-described features are described merely as an example in accordance with the present disclosure, and it should be understood that other types of procedures and recommendations are also possible.

As previously described, the user device 220 may be configured to receive a notification and present the notification on the display 301 of the user device 220 in the form of the GUI 300 illustrated in FIG. 9. Further, as described above, the user of the user device 220 may be presented with a request to respond to the notification and/or take other actions (e.g., in the indication 318 illustrated in FIG. 9), such as acknowledging receipt of the notification, indicating that the leak has been mitigated/repaired/blocked, or affirming that a notification should be transmitted to the security server (e.g., third party security server, such as a paid monitoring service server or a fire department server).

In some embodiments, a separate notification may be transmitted to a security server if the user does not respond to all or some of the prompts within a pre-defined amount of time. Accordingly, a countdown clock or timer 320 may be presented on the GUI 300, and if the user does not provide one or more of the above-described responses within the pre-defined amount of time counted down on the countdown clock or timer 320, a separate notification may be transmitted (e.g., via the user device 220 or another device illustrated in earlier drawings, such as the auxiliary controller 110 or HVAC controller 102) to a device corresponding to the security server. In other embodiments, a notification may be automatically transmitted (e.g., without input from the user) to the security sever in response to the extent or severity of the HVAC system refrigerant leak being relatively high. In any case, the notification transmitted to the security sever may include the same, similar, or different information than the notification transmitted to the user device 220.

Further to the features above, it should be noted that any notification transmitted to the third party security server (and, in some embodiments, to the user device 220) may also include information indicative of the building (e.g., building specifications) and/or HVAC system (e.g., HVAC specifications). Such information may enable emergency response teams (e.g., firefighters) to safely navigate the building and address any risks associated with the HVAC system refrigerant leak. Such information may be included, for example, in the safety protocol(s) and/or recommendations for mitigating/repairing/blocking the HVAC system leak.

Figure 10:
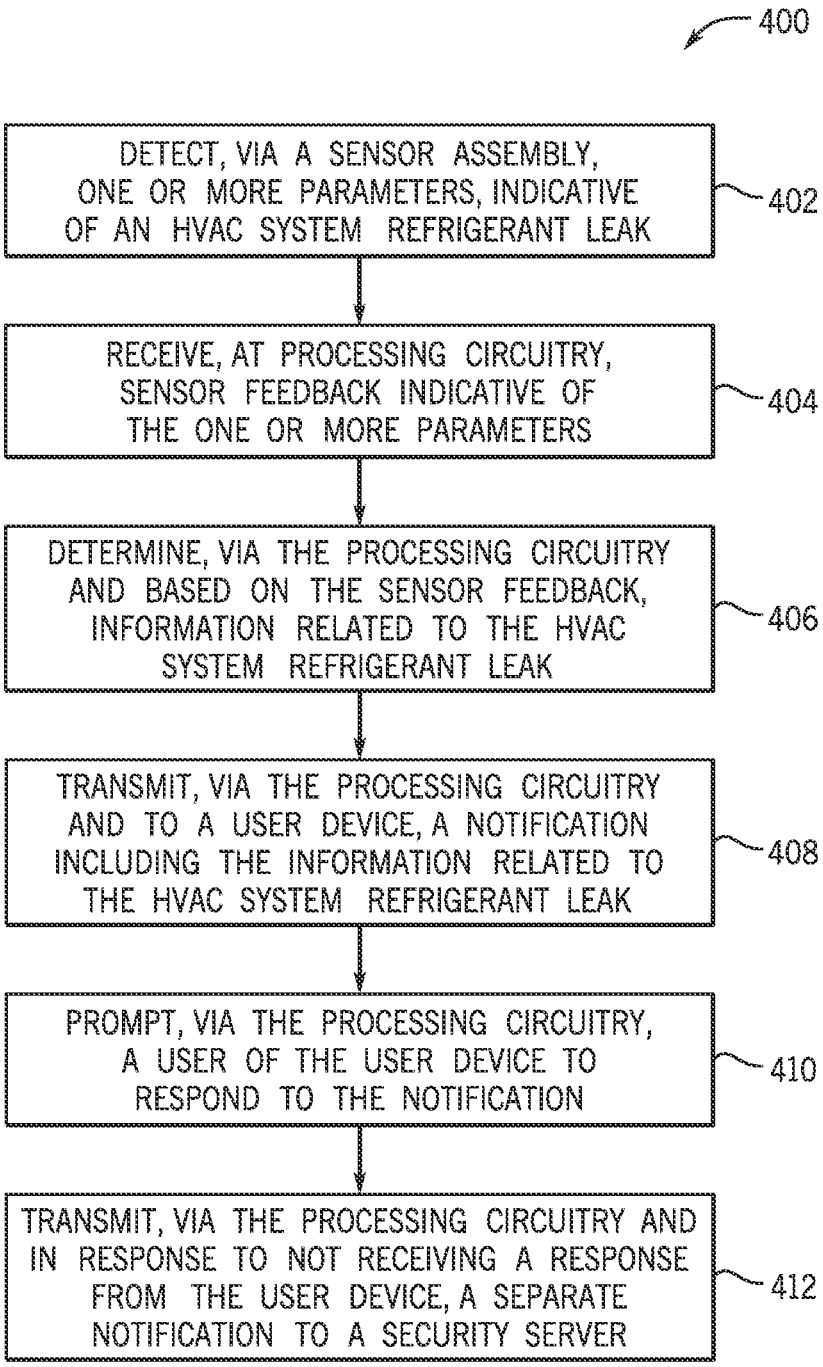
FIG. 10 is a process flow diagram illustrating a method of operating a refrigerant leak detection assembly, in accordance with an aspect of the present disclosure.

FIG. 10 is a process flow diagram illustrating an embodiment of a method 400 of operating a refrigerant leak detection assembly. In the illustrated embodiment, the method 400 includes detecting (block 402), via a sensor assembly, one or more parameters indicative of an HVAC system refrigerant leak. As previously described, the sensor assembly includes at least one sensor configured to detect a parameter indicative of an HVAC system refrigerant leak. The parameter may include, for example, a concentration of refrigerant in air, a vibration (e.g., of a component of the HVAC system, where the vibration profile may indicate a refrigerant leak), a pressure (e.g., of the refrigerant within the refrigeration circuit), or some other parameter indicative of an HVAC system refrigerant leak.

The method 400 also includes receiving (block 404), at processing circuitry, sensor feedback indicative of the one or more parameters. The method 400 also includes determining (block 406), via the processing circuitry and based on the sensor feedback, information related to the HVAC system refrigerant leak, such as a presence of the leak, a location of the leak, a severity of the leak, etc.

The method 400 also includes transmitting (block 408), via the processing circuitry and to a user device, a notification including the information indicative of the HVAC system refrigerant leak. The user device may, for example, correspond to a user, owner, manager, or other person associated with the HVAC system and/or the building or space being conditioned by the HVAC system. As previously described, the notification may indicate the location of the leak, source of the leak, time the leak was detected, severity or extent of the leak, safety protocols (e.g., corresponding to the severity or extent of the leak), leak mitigation/repair/blockage recommendations, and/or other information. The method 400 may also include prompting (block 410), via the processing circuitry, the user of the user device to respond to the notification (e.g., acknowledging receipt of the notification, indicating that the leak has been mitigated/repaired/blocked, or both). The prompt may be included in the notification, and may include an indication of a pre-defined threshold amount of time by which the processing circuitry should receive the response from the user device.

The method 400 also includes transmitting (block 412), via the processing circuitry and in response to not receiving a response from the user device (e.g., within the above-described pre-defined threshold amount of time), a separate notification to a security server (e.g., a third party security server, such as a paid monitoring service server, a fire department server, etc.). Depending on the embodiment, the separate notification to the security server (or device corresponding thereto) may include the same, similar, or different information than the notification to the user device.

Figure 11:
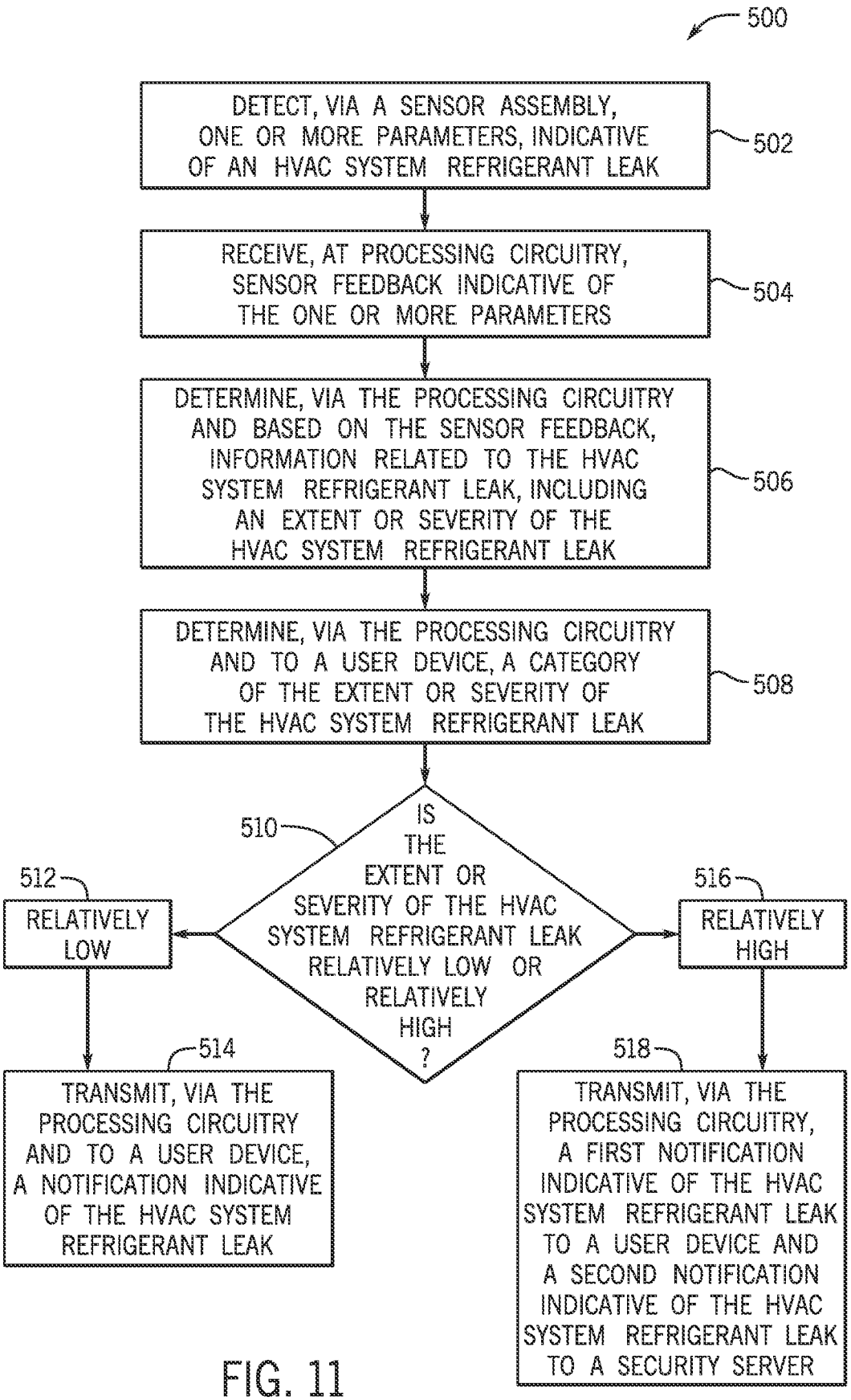
FIG. 11 is a process flow diagram illustrating a method of operating a refrigerant leak detection assembly, in accordance with an aspect of the present disclosure.

FIG. 11 is a process flow diagram illustrating an embodiment of another method 500 of operating a refrigerant leak detection assembly. In the illustrated embodiment, blocks 502 and 504 of the method 500 may be the same as, or similar to, blocks 402 and 404 of the method 400 of FIG. 10.

Continuing with the embodiment illustrated in FIG. 11, the method 500 includes determining (block 506), via the processing circuitry and based on the sensor feedback, information related to the HVAC system refrigerant leak, including an extent or severity of the HVAC system refrigerant leak. Further, the method 500 includes determining (block 508), via the processing circuitry, a category or level of the extent or severity of the HVAC system refrigerant leak (e.g., [1] relatively low or relatively high, [2] low, medium, or high, etc.). The category or level of the extent or severity of the HVAC system refrigerant leak, as previously described, may be determined based on comparison of the sensor feedback against one or more thresholds. For example, the concentration of refrigerant in air detected by the sensor assembly may be compared against one or more concentration thresholds, or the pressure of the refrigerant in the refrigeration circuit and detected by the sensor assembly may be compared against one or more pressure thresholds, depending on the embodiment. Other parameters and thresholds are also possible.

The method 500 in the illustrated embodiment includes determining (block 510) whether the severity of the HVAC system refrigerant leak is relatively low or relatively high. In response to determining that the severity of the HVAC system refrigerant leak is relatively low (block 512), a notification indicating the HVAC system refrigerant leak may be transmitted (block 514), via the processing circuitry, to a user device. The notification may include various information related to the HVAC system refrigerant leak, such as a location of the leak, the extent or severity of the leak, safety protocols associated with the extent or severity of the leak, recommendations or guides regarding how to mitigate/repair/block the leak, etc.

Continuing again with block 510, in response to determining that the severity of the HVAC system refrigerant leak is relatively high (block 516), various notifications may be transmitted to various devices. For example, in response to block 516, the method 500 may include transmitting (block 518), via the processing circuitry, a first notification indicative of the HVAC system refrigerant leak to the user device and a second notification indicative of the HVAC system refrigerant leak to a security server (e.g., third party security server, such as a paid monitoring service server or a fire department server). The first notification and the second notification may include the same information, similar information, or different information, depending on the embodiment.

In either of the methods 400, 500 illustrated in FIGS. 10 and 11, the notification transmitted to the third party security server may also include information indicative of the building (e.g., building specifications) and/or HVAC system (e.g., HVAC specifications). Such information may enable emergency response teams (e.g., firefighters) to safely navigate the building and address any risks associated with the HVAC system refrigerant leak. Such information may be included, for example, in the safety protocol(s) and/or recommendations for mitigating/repairing/blocking the HVAC system leak.

The present disclosure may provide one or more technical effects useful in the operation of an HVAC system. For example, presently disclosed embodiments may enable improved detection of HVAC system refrigerant leaks, improved notification of HVAC system refrigerant leaks, and improved response to HVAC system refrigerant leaks, relative to traditional embodiments.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system comprising a closed-loop refrigeration circuit, a plurality of devices, and a refrigerant leak detection system, the refrigerant leak detection system comprising:

a sensor configured to detect a leaked portion of a refrigerant external to the closed-loop refrigeration circuit of the HVAC system;

memory circuitry having instructions stored thereon; and processing circuitry configured to execute the instructions to:

receive, from the sensor, sensor feedback indicative of the leaked portion of the refrigerant;

perform, based on the sensor feedback, at least one refrigerant leakage prevention operation with respect to at least one device of the plurality of devices;

determine, based on the sensor feedback, at least one characteristic indicative of an extent of an HVAC system leak corresponding to the leaked portion of the refrigerant, a location of the HVAC system leak, or both;

transmit a first notification indicative of the leaked portion of the refrigerant to a user device in response to the at least one characteristic corresponding to at least one first reference characteristic; and transmit a second notification indicative of the leaked portion of the refrigerant to a third party security server in response to the at least one characteristic corresponding to at least one second reference characteristic, wherein the at least one second reference characteristic is different than the at least one first reference characteristic.

2. The HVAC system of claim 1, wherein the plurality of devices comprises:

a compressor, and the least one refrigerant leakage prevention operation comprises stopping the compressor;

a fan, and the at least one refrigerant leakage prevention operation comprises controlling a speed of the fan; or a damper, and the at least one refrigerant leakage prevention operation comprises opening or closing the damper.

3. The HVAC system of claim 1, wherein the processing circuitry is configured to execute the instructions to:

determine, based on the sensor feedback, the location of the HVAC system leak in the closed-loop refrigeration circuit of the HVAC system;

determine, based on the sensor feedback, the extent of the HVAC system leak; and include, in the first notification or the second notification, a first indication of the location of the HVAC system leak and a second indication of the extent of the HVAC system leak.

4. The HVAC system of claim 1, wherein the refrigerant leak detection system comprises an additional sensor configured to detect an additional leaked portion of the refrigerant external to the closed-loop refrigeration circuit of the HVAC system, wherein the sensor is disposed in a first zone corresponding to the closed-loop refrigeration circuit, the additional sensor is disposed in a second zone corresponding to the closed-loop refrigeration circuit, and the processing circuitry is configured to execute the instructions to:

determine, based on the sensor feedback, that the HVAC system leak in the closed-loop refrigeration circuit corresponds to the first zone corresponding to the closed-loop refrigeration circuit;

determine, based on additional sensor feedback from the additional sensor or a lack of the additional sensor feedback, that the HVAC system leak in the closed-loop refrigeration circuit does not correspond to the second zone corresponding to the closed-loop refrigeration circuit; and include, in the first notification or the second notification, an indication of the location of the HVAC system leak at the first zone corresponding to the closed-loop refrigeration circuit.

5. The HVAC system of claim 1, wherein the processing circuitry is configured to execute the instructions to:

determine, based on the sensor feedback, the extent of the HVAC system leak corresponding to the leaked portion of the refrigerant;

determine whether the extent exceeds a threshold extent;

include, in the first notification or the second notification, a first indication of a first protocol in response to the extent exceeding the threshold extent; and include, in the first notification or the second notification, a second indication of a second protocol in response to the extent not exceeding the threshold extent.

6. The HVAC system of claim 5, wherein the first indication of the first protocol or the second indication of the second protocol includes an instruction to evacuate a space corresponding to the HVAC system.

7. The HVAC system of claim 5, wherein the first indication of the first protocol or the second indication of the second protocol includes a recommendation to furnish fire suppression equipment.

8. The HVAC system of claim 1, comprising the third party security server, wherein the third party security server corresponds to a fire department server or a paid fire alarm monitoring service server.

9. The HVAC system of claim 1, wherein the at least one first characteristic corresponding to the at least one first reference characteristic indicates that the extent of the HVAC system leak corresponds to a first severity, the at least one second characteristic corresponding to the at least one second reference characteristic indicates that the extent of the HVAC system leak corresponds to a second severity, and the second severity is greater than the first severity.

10. One or more tangible, non-transitory, computer-readable media storing instructions thereon that, when executed by one or more processors, are configured to cause the one or more processors to:

receive, from a sensor assembly, sensor feedback indicative of a leaked portion of a refrigerant corresponding to a heating, ventilation, and/or air conditioning (HVAC) system;

perform, based on the sensor feedback, at least one refrigerant leakage prevention operation by controlling at least one device of the HVAC system;

determine, based on the sensor feedback, a refrigerant leak location of the HVAC system corresponding to the leaked portion of the refrigerant;

determine, based on the sensor feedback, a refrigerant leak severity corresponding to the leaked portion of the refrigerant;

determine whether the refrigerant leak severity exceeds a threshold severity;

generate a notification indicating a presence of the leaked portion of the refrigerant, the refrigerant leak location, and the refrigerant leak severity;

transmit the notification to a user device in response to the refrigerant leak severity not exceeding the threshold severity; and transmit the notification to a third party security server in response to the refrigerant leak severity exceeding the threshold severity.

11. The one or more tangible, non-transitory, computer-readable media of claim 10, wherein the instructions, when executed by the one or more processors, are configured to cause the one or more processors to perform, based on the sensor feedback, the at least one refrigerant leakage prevention operation by controlling the at least one device of the HVAC system by:

stopping operation of a compressor;

controlling a speed of a fan; or opening or closing a damper.

12. The one or more tangible, non-transitory, computer-readable media of claim 10, wherein the instructions, when executed by the one or more processors, are configured to cause the one or more processors to:

receive, from a sensor of the sensor assembly, the sensor feedback indicative of the leaked portion of the refrigerant; and determine, based on the sensor feedback and based on either additional sensor feedback from an additional sensor of the sensor assembly or a lack of the additional sensor feedback from the additional sensor of the sensor assembly, that the refrigerant leak location corresponding to the leaked portion of refrigerant is present at a first HVAC system zone corresponding to the sensor and not at a second HVAC system zone corresponding to the additional sensor.

13. The one or more tangible, non-transitory, computer-readable media of claim 10, wherein the instructions, when executed by the one or more processors, are configured to cause the one or more processors to:

include, in the notification, a first indication of a first safety protocol in response to the refrigerant leak severity exceeding the threshold severity; and include, in the notification, a second indication of a second safety protocol in response to the refrigerant leak severity not exceeding the threshold severity.

14. The one or more tangible, non-transitory, computer-readable media of claim 13, wherein the first indication of the first safety protocol or the second indication of the second safety protocol includes an instruction to evacuate a space corresponding to the HVAC system.

15. A method of detecting refrigerant leaks in a heating, ventilation, and/or air conditioning (HVAC) system, comprising:

receiving, via processing circuitry and from a sensor, sensor feedback indicative of a leaked portion of a refrigerant corresponding to the HVAC system;

performing, via the processing circuitry and based on the sensor feedback, at least one refrigerant leakage prevention operation by controlling at least one device of the HVAC system;

determining, via the processing circuitry and based on the sensor feedback, at least one characteristic indictive of an extent of an HVAC system leak corresponding to the leaked portion of the refrigerant, a location of the HVAC system leak, or both;

transmitting, via the processing circuitry, a notification indicative of the leaked portion of the refrigerant to a user device in response to determining that the at least one characteristic corresponds to at least one reference characteristic;

receiving, via the processing circuitry and from the sensor, additional sensor feedback indicative of an additional leaked portion of the refrigerant corresponding to the HVAC system;

determining, via the processing circuitry and based on the additional sensor feedback, at least one additional characteristic indictive of an additional extent of an additional HVAC system leak corresponding to the additional leaked portion of the refrigerant, an additional location of the additional HVAC system leak, or both; and transmitting, via the processing circuitry, an additional notification indicative of the additional leaked portion of the refrigerant to a third party security server in response to determining that the at least one additional characteristic corresponds to at least one additional reference characteristic, wherein the at least one additional reference characteristic is different than the at least one reference characteristic.

16. The method of claim 15, comprising:

determining, via the processing circuitry and based on the sensor feedback, the location of the HVAC system leak corresponding to the leaked portion of the refrigerant; and including, in the notification, an indication of the location of the HVAC system leak.

17. The method of claim 15, comprising:

determining, via the processing circuitry and based on the sensor feedback, the extent of the HVAC system leak corresponding to the leaked portion of the refrigerant; and including, in the notification, an indication of the extent of the HVAC system leak.

18. The method of claim 17, comprising:

determining, via the processing circuitry, that the extent exceeds a threshold extent;

including, in the notification, a first indication of a first safety protocol corresponding to the extent exceeding the threshold extent; and excluding, from the notification, a second indication of a second safety protocol corresponding to the extent not exceeding the threshold extent.

19. The method of claim 18, wherein the first indication of the first safety protocol includes a recommendation to evacuate a space corresponding to the HVAC system.

20. The method of claim 15, wherein performing, via the processing circuitry and based on the sensor feedback, at least one refrigerant leakage prevention operation by controlling at least one device of the HVAC system comprises:

stopping a compressor;

controlling a speed of a fan; or opening or closing a damper.

* * * * *